US007293382B2

(12) United States Patent
Polvere et al.

(10) Patent No.: US 7,293,382 B2
(45) Date of Patent: Nov. 13, 2007

(54) CONTAINMENT CLIP FOR A DISPLAY

(75) Inventors: Dennis Polvere, Millstone Township, NJ (US); Greg Gannon, Port Washington, NY (US)

(73) Assignee: Unified Resources In Display, Kenilworth, NJ (US)

( * ) Notice: Subject to any disclaimer, the term of this patent is extended or adjusted under 35 U.S.C. 154(b) by 140 days.

(21) Appl. No.: 10/853,979

(22) Filed: May 25, 2004

(65) Prior Publication Data

US 2005/0262745 A1 Dec. 1, 2005

(51) Int. Cl.
*G09F 7/02* (2006.01)

(52) U.S. Cl. ..... 40/611.02; 40/611.08

(58) Field of Classification Search ..... 40/766, 40/767, 611.02, 611.07, 611.08, 492, 576, 40/765; 292/80, 91, 323, 327, 316, 318, 292/319, 322, 324, 307 A; 403/326, 329; 24/453, 458; 411/510, 398, 400
See application file for complete search history.

(56) References Cited

U.S. PATENT DOCUMENTS

| | | | | | |
|---|---|---|---|---|---|
| 709,466 | A | * | 9/1902 | Butt | 40/611.04 |
| 828,161 | A | * | 8/1906 | Whitcomb | 40/338 |
| 1,116,628 | A | | 11/1914 | Reith et al. | |
| 1,159,465 | A | | 11/1915 | Brandenburg | |
| 1,853,703 | A | | 4/1932 | Send | |
| 3,161,974 | A | | 12/1964 | Blockson | |
| 3,564,744 | A | * | 2/1971 | Shook | 40/594 |
| 3,883,967 | A | * | 5/1975 | Barnes | 40/611.05 |
| 4,041,628 | A | * | 8/1977 | Sasson | 40/111 |
| 4,693,026 | A | | 9/1987 | Callahan et al. | 40/576 |
| 5,444,930 | A | | 8/1995 | Loew | 40/544 |

* cited by examiner

*Primary Examiner*—Joanne Silbermann
(74) *Attorney, Agent, or Firm*—Winston & Strawn LLP

(57) ABSTRACT

A display is described of the type including a supporting frame that includes track members in spaced relation to define a channel therebetween to receive signage material. The device includes a containment clip operatively associated with the display and moveable between opened and closed positions. The clip includes at least one channel blocking portion connected to a pin member for securing the clip to the display. In the closed position, the channel blocking portion blocks the channel to prevent exiting of the signage material. In the opened position, the channel blocking portion is sufficiently displaced from the channel to allow removal or replacement of the signage material in the channel.

14 Claims, 4 Drawing Sheets

CONTAINMENT CLIP FOR A DISPLAY

BACKGROUND OF THE INVENTION

This invention generally relates to displays for advertising items. More particularly, the invention pertains to a display that includes a containment clip that, when in an open position, operates to allow removal or replacement of signage material, and when in a closed position blocks a channel to retain the signage material within the display.

Conventional display signs used in card stores, supermarkets, convenience stores, and the like, utilize rectangular-shaped graphics or printed materials that may include letters and numbers that slide into a plurality of channels formed by spaced-apart tracks of the display. Such signage is used to advertise various products and to display current selling prices. For items such as cigarettes, that change price fairly frequently, it is advantageous for store owners to merely have to remove and replace a few signage elements to update their store displays. These displays typically also include clip-on members that rely on tension to retain the signage elements in their channels on the display. However, repetitive use due to frequent changes of the signage materials causes fatigue so that the clip-on members loose their effectiveness over time, resulting in their failure. Such failures can lead to a disheveled display appearance or having some or all of the signage elements fall out of their respective display channels. In addition, some clip-on members are small and thus are easily lost or displaced in a busy store environment. In some retail environments, store personnel will not make signage changes if clip-on members are missing or broken, and thus some advertising displays of this type are underutilized.

A need therefore exists for a containment element that provides improved signage support without the drawbacks mentioned above, so that advertising displays are fully utilized.

SUMMARY OF THE INVENTION

The invention relates to a display apparatus comprising a supporting frame that includes track members in spaced relation to define a channel therebetween to receive signage material therein; and a containment clip operatively associated with the display and moveable between opened and closed positions. The clip advantageously comprises a channel blocking portion connected to a pin member for securing the clip to the display. In the closed position, the channel blocking portion blocks the channel to prevent exiting or removal of the signage material, and, in the opened position, the channel blocking portion is sufficiently displaced from the channel to allow removal or replacement of the signage material in the channel.

Preferably, the channel blocking portion is rotatable between the opened and closed positions. Also, the pin member can be configured to securely retain the channel blocking portion in an opened or closed position. To assist in this, the pin member may further comprise at least one rib for retaining the containment clip on the display.

The channel blocking portion and pin member of the containment clip are preferably formed as an integral component, such as one of injection molded plastic. If desired, the containment clip can further comprise a flange for grasping the clip to assist in moving the clip between the first and second positions. In additional embodiments, the containment clip further comprises a biasing device for biasing the containment clip in the closed position, or alignment elements associated with the channel blocking portion. These alignment elements may comprise a pair of spaced, raised elements which engage the apparatus to fix the containment clip in the closed position.

The channel blocking portion is of a generally teardrop shape having relatively narrower and relatively wider portions, with the relatively narrower portion being positioned closer to the pin member. The shape of the channel blocking portion is weighted to bias the containment clip to the closed position under the influence of gravity. In a further embodiment, the channel blocking portion is of a generally bowtie shape having a relatively narrower portion positioned between two relatively wider portions, with the relatively narrower portion being positioned closer to the pin member. Also, the relatively narrower portion of either embodiment may be connected to the pin member.

The details of one or more embodiments of the invention are set forth in the accompanying drawings and the detailed description below. Other features and advantages of the invention will be apparent from the detailed description and drawings, and from the claims.

BRIEF DESCRIPTION OF THE DRAWING FIGURES

Preferred embodiments of the invention will become apparent in view of the following detailed description that is viewed in conjunction with the attached drawing figures, wherein.

Like reference symbols in the various drawings indicate like elements.

DETAILED DESCRIPTION OF THE PREFERRED EMBODIMENTS

Figure 1:
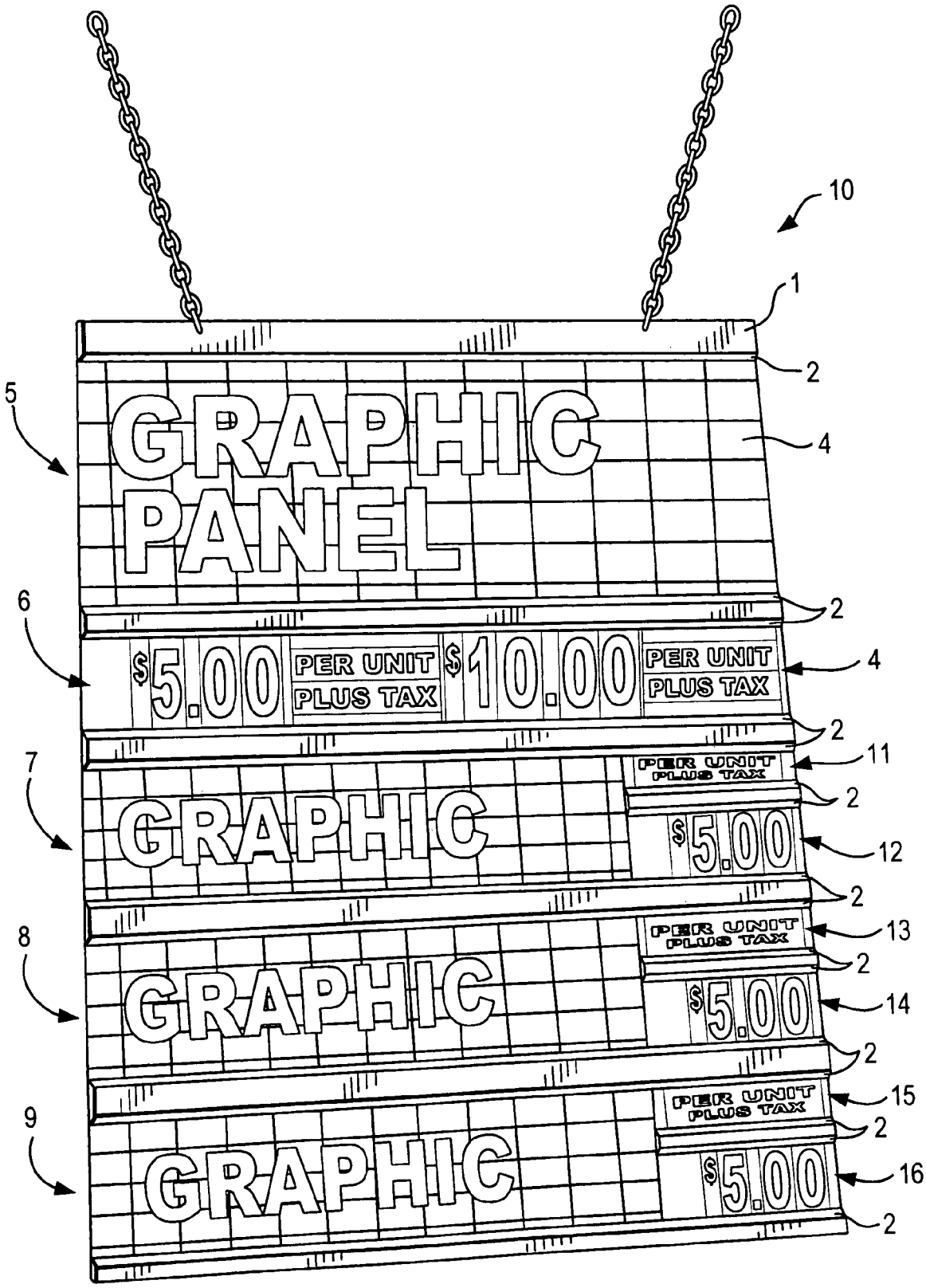
FIG. 1 is a front view of an exemplary display that includes a plurality of channels for supporting various signage materials for use in accordance with the invention.

FIG. 1 is a front view of an exemplary hanging-type display 10 that includes a supporting frame 1 having a plurality of molded or extruded track members 2 in spaced apart relation to define channels therebetween, for supporting various signage elements 4 in the form of graphics and/or printed materials. For example, the signage material may be in the form of advertising and/or price information for one or more products or items. A word representation, or a logo, or other graphic or written indicia indicative of a product or service, for example, may be printed on a rectangular piece of paper or cardboard stock, for example. The rectangular piece has dimensions that enable it to be inserted between two of the adjacent track members 2 for support and display in that channel. In the example shown in FIG. 1, the display 10 includes five rows or channels labeled 5 to 9 that contain different information in each row. In addition, as shown on the right side of FIG. 1, row 7 includes sub-channels 11 and 12, row 8 includes sub-channels 13 and 14, and row 9 includes sub-channels 15 and 16. Each of these sub-channels includes two tracks 2 that have a smaller distance therebetween to accept smaller sized signage materials. The number of tracks that are included and the spacing between them are not critical and can be selected by the skilled artisan depending upon what signage or combination of signage is to be displayed.

Figure 2:
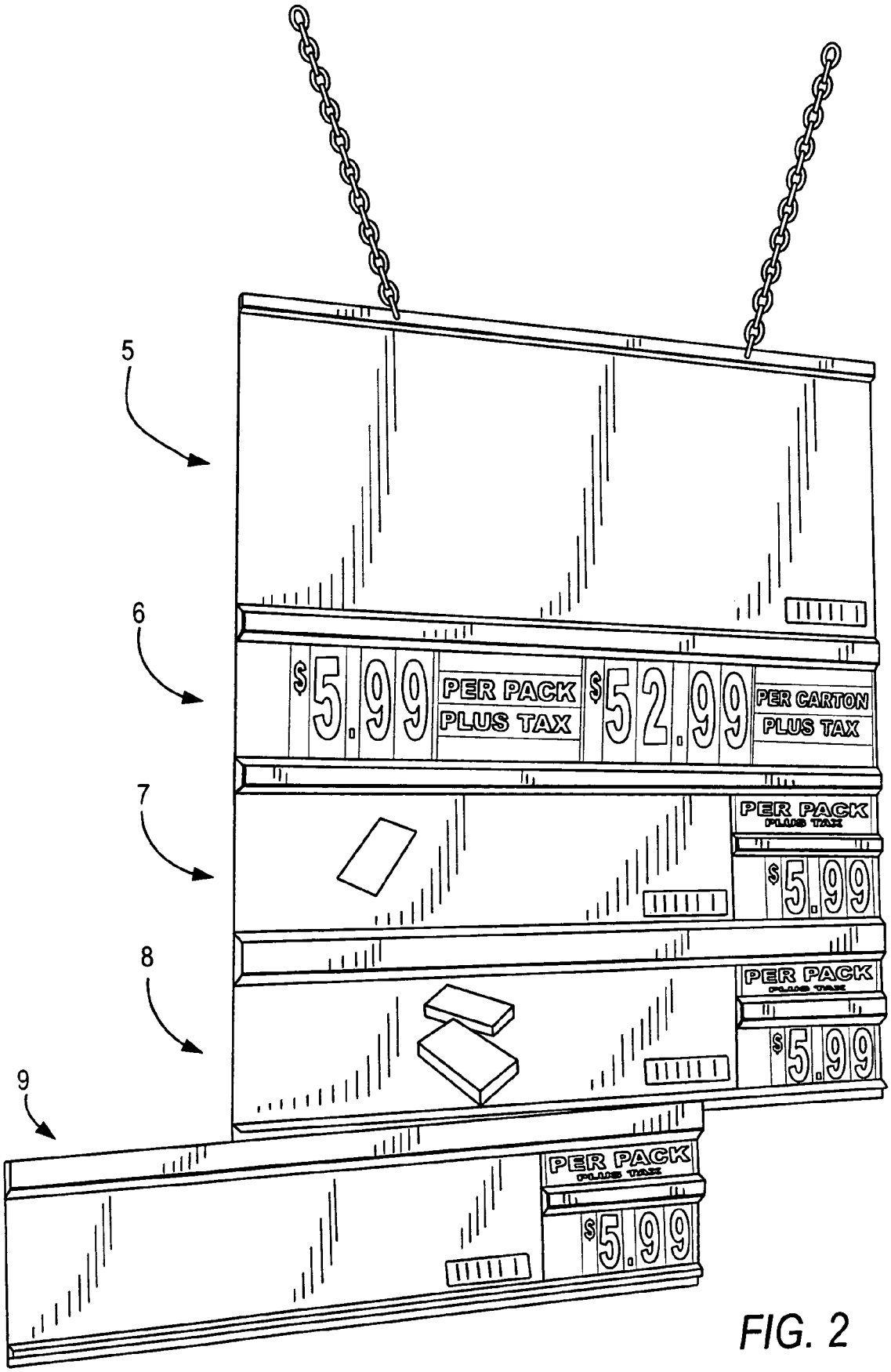
FIG. 2 is another view of the display of FIG. 1 illustrating the partial removal of an entire row in order to make the display smaller in size.

FIG. 2 is another view of the display of FIG. 1 showing row 9 partially removed, wherein a user wishes to decrease the overall size of the display 10. Instead of removing the entire row 9, a user could just slide out the existing signage and replace it with other signage. If desired, additional rows can be added to increase the number of products that are to be displayed on the device.

Figure 3:
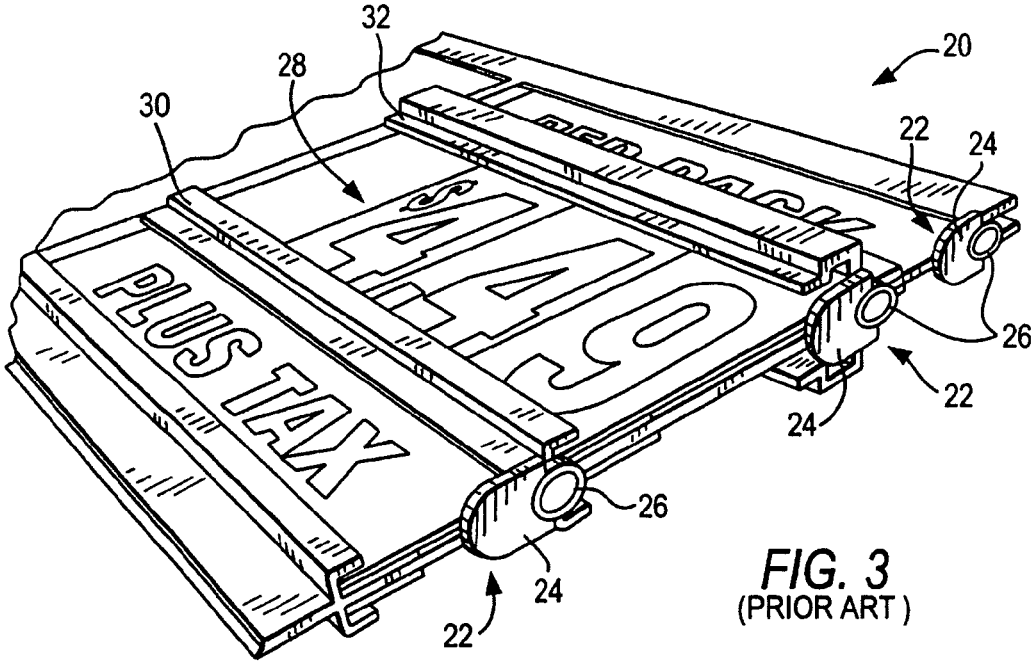
FIG. 3 (PRIOR ART)
FIG. 3 is an enlarged perspective view of a portion of a row illustrating conventional manual slip-in retainers.

FIG. 3 is an enlarged perspective view of a portion of a row 20 of a display like that shown in FIGS. 1 and 2 illustrating conventional manual slip-in retainers 22. The slip-in retainers include a stop portion 24 and a bolt having a head portion 26. The barrel portion (not shown) of the bolt resides within the display 20, and the stop portion 24 is freely rotatable about the head portion 26. In order to permit signage elements 28 to slide in or out of the channel between tracks 30 and 32, a user would rotate the stop portion about the head portion 26 and hold the stop portion in a position away from the top edge of the signage material. When the signage material has been inserted into the channels and the display sign is in use, the head portions 26 of the slip-in retainers 22 hang downward under the influence of gravity to block the signage materials from sliding out of the channels.

Figure 4A:
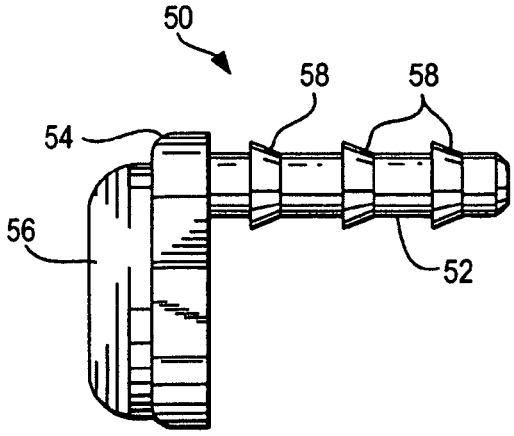
FIGS. 4A to 4C are side, front and rear views, respectively, of an embodiment of a containment clip according to the invention.
Figure 4B:
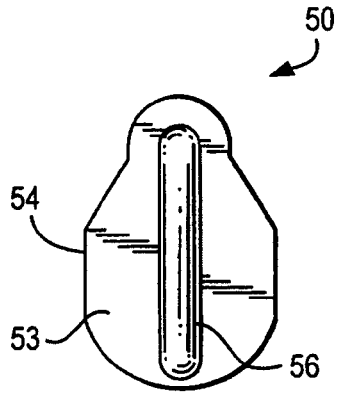
Figure 4C:
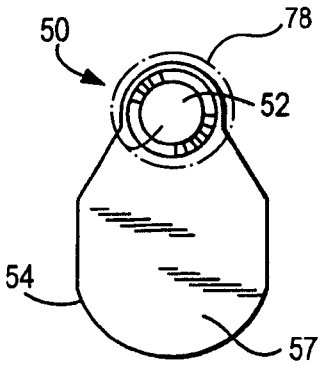

FIGS. 4A to 4C are side, front and rear views, respectively of an embodiment of the present containment clip 50 according to the invention. Referring to FIG. 4A, the containment clip includes a pin member 52 and channel blocking portion 54. In this implementation, a flange 56 is included on the front surface 53 of the channel blocking portion 54 to provide a handle sized for easy grasping by a user's fingers. Thus, a user grasps the flange 56 and turns it to rotate the channel blocking member 54 away from the track in the channel to which it is associated, and then load the display with signage or remove signage from the channel. Also included is a plurality of ribs 58 on the pin member 52. These ribs 58 are configured in a way to resist removal of the pin member 52 from the device. Also, these ribs can be configured to stiffen the engagement of the pin with the sign so that it can be fixed in the open or closed position without free movement. Of course, in a preferred arrangement, the stiffness of the connection is not so great that it cannot be overcome with a person's hand force or small tool for ease of movement of the channel blocking member between the closed and open positions.

The containment clip 50 is operatively associated with the display, and in an embodiment is attached to the display and is an integral part of the display. Thus, the containment clip 50 is not removable. In this configuration, the channel blocking portion 54 pivots about the pin member 52 when in use. In the closed position, the channel blocking portion 54 blocks one of the tracks of a channel to prevent exiting or removal of the signage. In the open position, the channel blocking portion 54 is rotated to be sufficiently displaced from the track to allow removal or replacement of the signage in the channel.

In an implementation, the pin member 52 is operable to retain the channel blocking portion in the opened or closed position, and includes one or more ribs 58 that retain the containment clip on the display. The ribs 58 may also provide a friction fit within the display such that when the channel blocking portion 54 is moved to the opened position, the ribs 58 are operable for retaining the channel blocking portion in its displaced orientation away from the display channel until a user manually turns the containment clip to return it to the closed position. Alternately, the containment clip 50 may further include a biasing device, such as a conventional spring element 78, shown in phantom lines, that is attached to the pin member and to the device. This element can be used to bias the containment clip in the closed position so that the signage can be securely maintained in the channel of the track members. In yet another variation, the containment clip may include a conventional ratchet mechanism (not shown) to maintain the channel blocking portion in any one of a variety of orientations.

In an implementation, the channel blocking portion is about 0.6 inches long and about 0.5 inches wide, and the pin member 52 is about 0.7 inches in length and 0.125 inches in diameter. These measurements may be larger or smaller depending on such considerations as the size of the tracks and/or channels, and the required durability requirements. It should thus be understood that the containment clips are adaptable to multiple thicknesses and sizes to fit various types of displays.

Figure 4D:
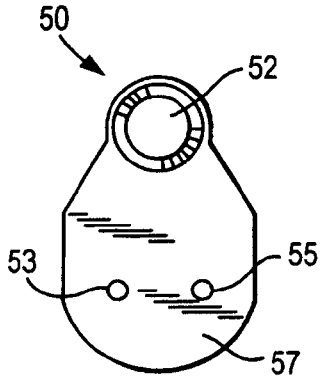
FIG. 4D illustrates an alternate embodiment of the containment clip of FIGS. 4A to 4C having a pair of alignment elements.

FIG. 4D illustrates an alternate embodiment of a containment clip 51 similar to that shown in FIGS. 4A to 4C but having a pair of alignment elements 53 and 55. The alignment elements may be a pair of raised bumps or protrusions, which may be made of elastic or other somewhat deformable, resilient material. In an embodiment, the alignment elements are located on the back surface 57 of the channel blocking portion 54, and are spaced apart to enable the alignment elements to obtain positions on the front side of the signage material and on the rear of the display. When the clip member is made of a molded plastic, the bumps will simply be molded in place and configured of a size to provide a tactile sensation that assures proper placement and locking of the blocking members adjacent the channel.

Figure 5A:
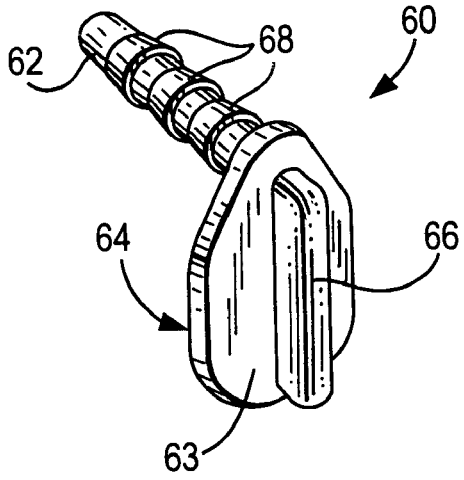
FIGS. 5A and 5B are front and rear views, respectively, of another embodiment of the containment clip according to the invention.
Figure 5B:
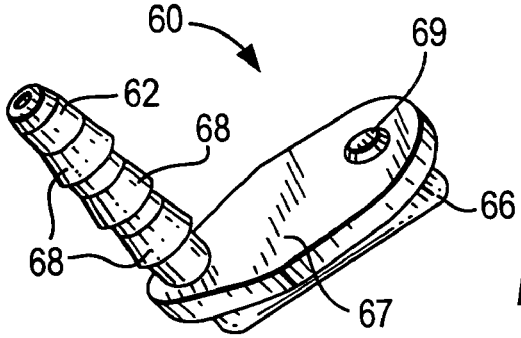

FIGS. 5A and 5*b* are front and rear perspective views, respectively, of another embodiment of the present containment clip 60 according to the invention. FIG. 5A shows that the containment clip 60 includes a pin member 62 and channel blocking portion 64. Also included is a flange 66 or handle on the front surface 63 of the channel blocking portion 64 for grasping by a user. In order to rotate the channel blocking member 64 away from the track in the channel to which it is associated, a user grasps the flange 66 and turns it so that it is possible to remove signage from, or to insert signage into, the channel. A plurality of ribs 68 is also included on the pin member 62, which are configured in a way to resist removal of the pin member 62 from the display device. Also, these ribs can be configured to stiffen the engagement of the pin with the sign so that it can be fixed in the open or closed position without free movement. Of course, as mentioned above, the stiffness of the connection should not be so great that it cannot be overcome with a person's hand force or small tool for ease of movement of the channel blocking member between the closed and open positions.

The containment clip 60 is also operatively associated with the display, and in an embodiment is attached to the display and is an integral part of the display. Thus, the containment clip 60 is not removable. In this configuration, the channel blocking portion 64 pivots about the pin member 62 when in use. In the closed position, the channel blocking portion 64 blocks at least one of the tracks of a channel to prevent exiting or removal of the signage. In the open position, the channel blocking portion 64 is rotated to be sufficiently displaced from the track to allow removal or replacement of the signage in the channel.

In an implementation, the pin member 62 is operable to retain the channel blocking portion in the opened or closed position, and the ribs 68 function to retain the containment clip on the display. The ribs 68 may also provide a friction fit within the display such that when the channel blocking portion 64 is moved to the opened position, the ribs 68 are operable for retaining the channel blocking portion in its displaced orientation away from the display channel until a user manually turns the containment clip to return it to the closed position. Alternately, the containment clip 60 may further include a biasing device, such as a conventional spring element (not shown), that is attached to the pin member and to the device. This element can be used to bias the containment clip in the closed position so that the signage can be securely maintained in the channel of the track members. In yet another variation, the containment clip may include a conventional ratchet mechanism (not shown) to maintain the channel blocking portion in any one of a variety of orientations.

FIG. 5B is a rear perspective view of the containment clip 60 of FIG. 5A. An alignment element 69 in the form of a bump or protrusion extends from rear face 67 of the channel blocking portion 64. The alignment element 69 may be sized to mate with a recess or receptacle (not shown) of a display device when the channel blocking portion 64 is in the closed position. The alignment element may be made of elastic or other somewhat deformable, resilient material. When the clip member is made of a molded plastic, the bump will simply be molded in place and be sized and configured to provide a tactile sensation that can be used by a person replacing or inserting signage to assure the proper placement and locking of the blocking members adjacent the channel.

It is noted that the containment clips shown in FIGS. 4A to 5B have channel blocking portions that are generally teardrop-shaped, but the shape is not critical. Other shapes could be utilized as long as the channel blocking portion blocks the signage from sliding out of a channel when the containment clip is in the closed position. It is also noted that a teardrop-shaped channel blocking portion may be weighted such that it generally biases the containment clip to the closed position under the influence of gravity. In addition, one skilled in the art would be able to choose a proper shape for the channel blocking member, and a suitable size of the overall containment clip so that it is suitable for use on a particular display.

Figure 6:
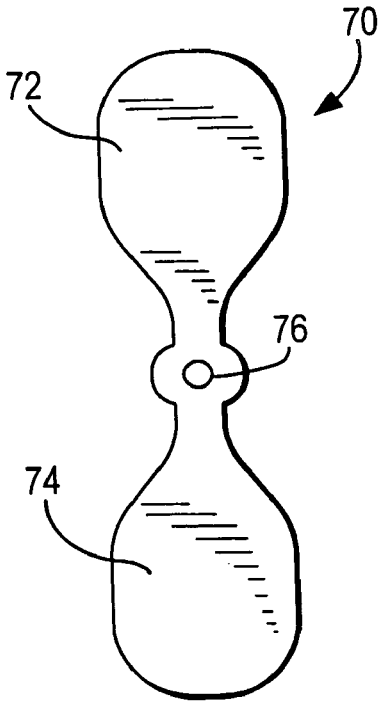
FIG. 6 illustrates a front view of an alternate embodiment of a containment clip according to the invention.

FIG. 6 illustrates a front view of an alternate embodiment of a containment clip 70 according to the invention. In this embodiment, two channel blocking portions 72 and 74 form an overall, generally bowtie shape, with the narrowest portion between them being connected to the pin 76. Such a containment clip 70 may be connected to the display in a position to block the tracks of two adjacent channels, so that it is operable to ensure that two signage materials are supported when in the closed position.

The containment clips described herein may be made of molded plastic, rubber or a durable composite material. The containment clips may be of a one piece, unitary construction, or may be made of several different elements. In a configuration, the pin member is made of steel, another type of metal, a composite material, or other durable material that minimizes the problem of fatigue associated with conventional retaining clips. However, the channel blocking portions are not designed to support the weight of any of the signage materials, but function as doors to prevent signage materials from sliding out of their channels when in the closed position and allowing passage when in the opened position.

A number of embodiments of the invention have been described. Nevertheless, it will be understood that various modifications may be made without departing from the spirit and scope of the invention. Accordingly, other embodiments are within the scope of the following claims.

What is claimed is:

1. A signage display apparatus comprising:

a supporting frame that includes track members in spaced relation to define a channel therebetween configured and dimensioned to receive and display signage material therein; and a containment clip operatively associated with the supporting frame and moveable between opened and closed positions, the clip comprising a channel blocking portion connected to a pin member for securing the clip to the display;

wherein, in the closed position, the channel blocking portion blocks the channel to prevent exiting or removal of the signage material, and, in the opened position, the channel blocking portion is sufficiently displaced from the channel to allow removal or replacement of the signage material in the channel;

wherein the pin member further comprises at least one rib for retaining the containment clip in the operative association with the supporting frame; and wherein the channel blocking portion and pin member of the containment clip are formed as an integral component in fixed association.

2. The signage display apparatus of claim 1 wherein the channel blocking portion is rotatable between the opened and closed positions.

3. The signage display apparatus of claim 1 wherein the pin member retains the channel blocking portion in an opened or closed position.

4. The signage display apparatus of claim 1 wherein the channel blocking portion is of a generally teardrop shape having relatively narrower and relatively wider portions, with the relatively narrower portion being positioned closer to the pin member.

5. The signage display apparatus of claim 4 wherein the relatively narrower portion is connected to the pin member.

6. The signage display apparatus of claim 4 wherein the shape of the channel blocking portion is weighted to bias the containment clip to the closed position under the influence of gravity.

7. A signage display apparatus comprising:

a supporting frame that includes track members in spaced relation to define a channel therebetween configured and dimensioned to receive and display signage material therein; and a containment clip operatively associated with the supporting frame and moveable between opened and closed positions, the clip comprising a flange for grasping the clip to assist in moving the clip between the opened and closed positions and a channel blocking portion connected to a pin member for securing the clip to the display;

wherein, in the closed position, the channel blocking portion blocks the channel to prevent exiting or removal of the signage material, and, in the opened position, the channel blocking portion is sufficiently displaced from the channel to allow removal or replacement of the signage material in the channel; and wherein the pin member further comprises at least one rib for retaining the containment clip in the operative association with the supporting frame.

8. The signage display apparatus of claim 7 wherein the channel blocking portion is rotatable between the opened and closed positions.

9. The signage display apparatus of claim 7 wherein the pin member retains the channel blocking portion in an opened or closed position.

10. The signage display apparatus of claim 7 wherein the channel blocking portion is of a generally teardrop shape having relatively narrower and relatively wider portions, with the relatively narrower portion being positioned closer to the pin member.

11. A signage display apparatus comprising:

a supporting frame that includes track members in spaced relation to define a channel therebetween configured and dimensioned to receive and display signage material therein; and a containment clip operatively associated with the supporting frame and moveable between opened and closed positions, the clip comprising a channel blocking portion connected to a pin member for securing the clip to the display;

wherein, in the closed position, the channel blocking portion blocks the channel to prevent exiting or removal of the signage material, and, in the opened position, the channel blocking portion is sufficiently displaced from the channel to allow removal or replacement of the signage material in the channel;

wherein the pin member further comprises at least one rib for retaining the containment clip in the operative association with the supporting frame; and wherein the containment clip further comprises alignment elements associated with the channel blocking portion, the alignment elements comprising a pair of spaced, raised elements which engage the apparatus to fix the containment clip in the closed position.

12. The signage display apparatus of claim 11 wherein the channel blocking portion is rotatable between the opened and closed positions.

13. The signage display apparatus of claim 11 wherein the pin member retains the channel blocking portion in an opened or closed position.

14. The signage display apparatus of claim 11 wherein the channel blocking portion is of a generally teardrop shape having relatively narrower and relatively wider portions, with the relatively narrower portion being positioned closer to the pin member.

* * * * *